United States Patent [19]

Wakatsuki et al.

[11] Patent Number: 5,027,615

[45] Date of Patent: Jul. 2, 1991

[54] REFRIGERATOR

[75] Inventors: Yuji Wakatsuki; Shigekazu Kondo; Mitsuyuki Takaoka; Masaru Hirosawa; Nobuya Suzuki, all of Sakae, Japan

[73] Assignee: Hoshizaki Denki Kabushiki Kaisha, Aichi, Japan

[21] Appl. No.: 532,947

[22] Filed: Jun. 4, 1990

[30] Foreign Application Priority Data

| | | | |
|---|---|---|---|
| Jun. 5, 1989 | [JP] | Japan | 1-142460 |
| Jun. 27, 1989 | [JP] | Japan | 1-164130 |
| Jul. 11, 1989 | [JP] | Japan | 1-81446 |

[51] Int. Cl.[5] ..... F25D 17/06

[52] U.S. Cl. ..... 62/419; 62/441

[58] Field of Search ..... 62/419, 441

[56] References Cited

U.S. PATENT DOCUMENTS

| | | | |
|---|---|---|---|
| 2,775,873 | 1/1957 | Jones | 62/441 X |
| 3,466,891 | 9/1969 | Maxwell | 62/441 X |
| 3,866,437 | 2/1975 | Spencer | 62/441 X |

*Primary Examiner*—Lloyd L. King

*Attorney, Agent, or Firm*—Koda and Androlia

[57] ABSTRACT

A refrigerator comprising a thermal insulation box, a plurality of storing boxes, a cooler, a horizontal passage and a partition plate, wherein the cold air coming from any one of the upper and lower internal spacings is communicated within the horizontal passage along the partition plate, and further the internal spacing of the thermal insulation box is divided into a first passage and a second passage, the horizontal passage and a first passage are divided into an upper segment and a lower segment by a partition plate, and the upper passage and the lower passage defined in the horizontal passage are communicated at a side opposite to a side communicating with the first passage.

6 Claims, 12 Drawing Sheets

REFRIGERATOR

FIELD OF THE INVENTION

This invention relates to a refrigerator in which a plurality of storing boxes are arranged within a thermal insulating box through a predetermined space, and more particularly, a refrigerator capable of making a rapid and uniform cooling within each of the storing boxes.

BACKGROUND OF THE INVENTION

In case that fresh foods such as vegetables, fruits, other meats and fishes and the like (hereinafter called as "meal products") are frozen and stored in the refrigerator for a long period of time or in case that the frozen meal products are gradually defrozen, in general, it is necessary to restrict a temperature variation within the refrigerator to a low degree and in addition to restrict and control moisture evaporation from the meal products.

In order to accommodate for this requirement, there is a device entitled "Fresh foodstuffs Storing Apparatus" of Jap. U.M. Laid-open No. Sho 63-147678, for example. In this apparatus, some storing boxes for storing meal products are installed within the storing chambers of thermal insulating structure through a predetermined space. The space within the refrigerator is divided by a horizontal partition plate and a vertical partition plate into a casing side air passage for communicating the cold air with the storing boxes without being contacted therewith and another air passage on the side of each storing box to cause the cold air to be communicated with the storing boxes while being contacted with the storing boxes. Then, after the cold air cooled by an evaporator arranged at the air passage on the casing side is dropped down at first at the air passage on the casing side and dropped down to the bottom part of a storing chamber, a heat exchanging operation is carried out with the storing boxes while the cold air is risen up in the air passage on the storing box side thereby the storing boxes are cooled.

The above-mentioned fresh foodstuff storing device is constructed such that the cooled cold air is descended down to the bottom part of the storing chamber, thereafter the storing boxes are cooled while the cold air ascends, Therefore, in case of the type in which a single storing box is stored within the storing chamber, the cold air ascends along the entire storing boxes, so that the storing boxes can be efficiently cooled. In case of a device in which a plurality of storing boxes are stored within the storing chamber in a vertical relation, the cold air ascending from the bottom part of the storing chamber is not sufficiently filled between the bottom surface of the upper storing box and a ceiling surface of the lower storing box, resulting in that each of the storing boxes may not sufficiently be cooled. Due to this fact, cooling of an interior of each of the storing boxes until it reaches a predetermined temperature (meal products storing temperature) requires a substantial time, resulting in providing a disadvantage that a power consumption is also increased.

In addition, if the cold air is descended down to the bottom part of the storing chamber at once, this cold air may not ascend, but accumulate, resulting in that only the lower storing box is cooled and so interior temperatures of upper and lower storing boxes are made non-uniform. Thus, a disadvantage is pointed out that cooling of the upper storing boxes is not sufficient and freshness of the stored meal products is decreased.

OBJECT OF THE INVENTION

This invention is proposed in view of the above-described disadvantages present in the refrigerator of double structure having a plurality of storing boxes arranged within the above-described thermal insulating box in a vertical relation so as to eliminate preferentially the disadvantages and it is an object of this invention to provide a refrigerator capable of performing a rapid cooling within the refrigerator to a predetermined temperature and at the same time capable of performing a uniform cooling of each of the storing boxes.

SUMMARY OF THE INVENTION

In order to eliminate the above-described problems and accomplish the desired object preferentially, this invention consists of a refrigerator comprising a thermal insulating box provided with a plurality of openings and thermal insulating doors arranged at each of the openings, a plurality of storing boxes arranged within the thermal insulating box in a vertical relation through a desired spacing and having openings released in response to the former openings, and a cooler arranged above the upper storing box in the thermal insulating box characterized in that the same is further comprised of a horizontal passage defined between the storing boxes arranged in a vertical relation and communicating with the interior space, and a partition for dividing the horizontal passage and the interior spacing into two upper and lower segments and communicating upper and lower passages within the horizontal passage apart from communicating part between the horizontal passage and the interior space and then the cold air coming from any of the upper and lower interior spaces is communicated within the horizontal passage along the partition.

That is, in case of the refrigerator of this invention, since it is constructed such that cold air is forcedly flown through the partition in the horizontal passage defined between the storing boxes arranged in a vertical relation, so that it is possible to improve a cooling effect within the upper and lower storing boxes. Accordingly, it is possible to shorten a time required for cooling the storing boxes down to a predetermined temperature and further to reduce a running cost. Since each of the storing boxes is cooled by a descending cold air and an ascending cold air, the storing boxes may be uniformly cooled and so this invention shows an effect capable of performing an effective prevention of deterioration in a degree of freshness of meal products stored within the upper and lower storing boxes.

Further, another invention of the present patent application for accomplishing the above-described object consists in a refrigerator comprising a thermal insulating box having a plurality of openings and thermal insulating doors arranged in each of the openings, a plurality of storing boxes arranged within the thermal insulating box in a vertical relation through a desired spacing and having openings released in response to the former openings, and a cooler arranged above the upper storing box in the thermal insulating box characterized in that the same is comprised of a first passage for guiding the cold air blown from the cooler and descending, a second passage for guiding the cold air descended in the first passage ascending to cause to be returned back again to the cooler, a horizontal passage defined by shielding members arranged oppositely at both right and left edges in a vertical opposed surface in the storing box, a partition plate for doubly defining the first passage facing outside of the upper storing box and the horizontal passage, and through-holes formed in the shielding members adjacent to the upper passage partitioned by the partition plate in the horizontal passage for communicating the upper passage with the second passage.

As described above, according to the refrigerator of the other invention of the present patent application, the cold air cooled by the cooler is branched into cold air adopted to cool the upper storing box and another cold air adopted to cool the lower storing box and circulated, thereby both storing boxes can be uniformly cooled. Accordingly, it is effectively possible to prevent a reduction in freshness of the meal products stored within the upper and lower storing boxes. The cold air can be contacted without any clearance with the bottom surface of the upper storing box and the ceiling surface of the lower storing box, so that a cooling efficiency of the upper and lower storing boxes can be improved and a time required for cooling the storing boxes down to the predetermined temperature can be shortened and further a running cost can be reduced.

DETAILED DESCRIPTION OF THE INVENTION

Referring now to the accompanying drawings, some preferred embodiments of the refrigerator of this invention will be described as follows.

(First Preferred Embodiment)

Figure 1:
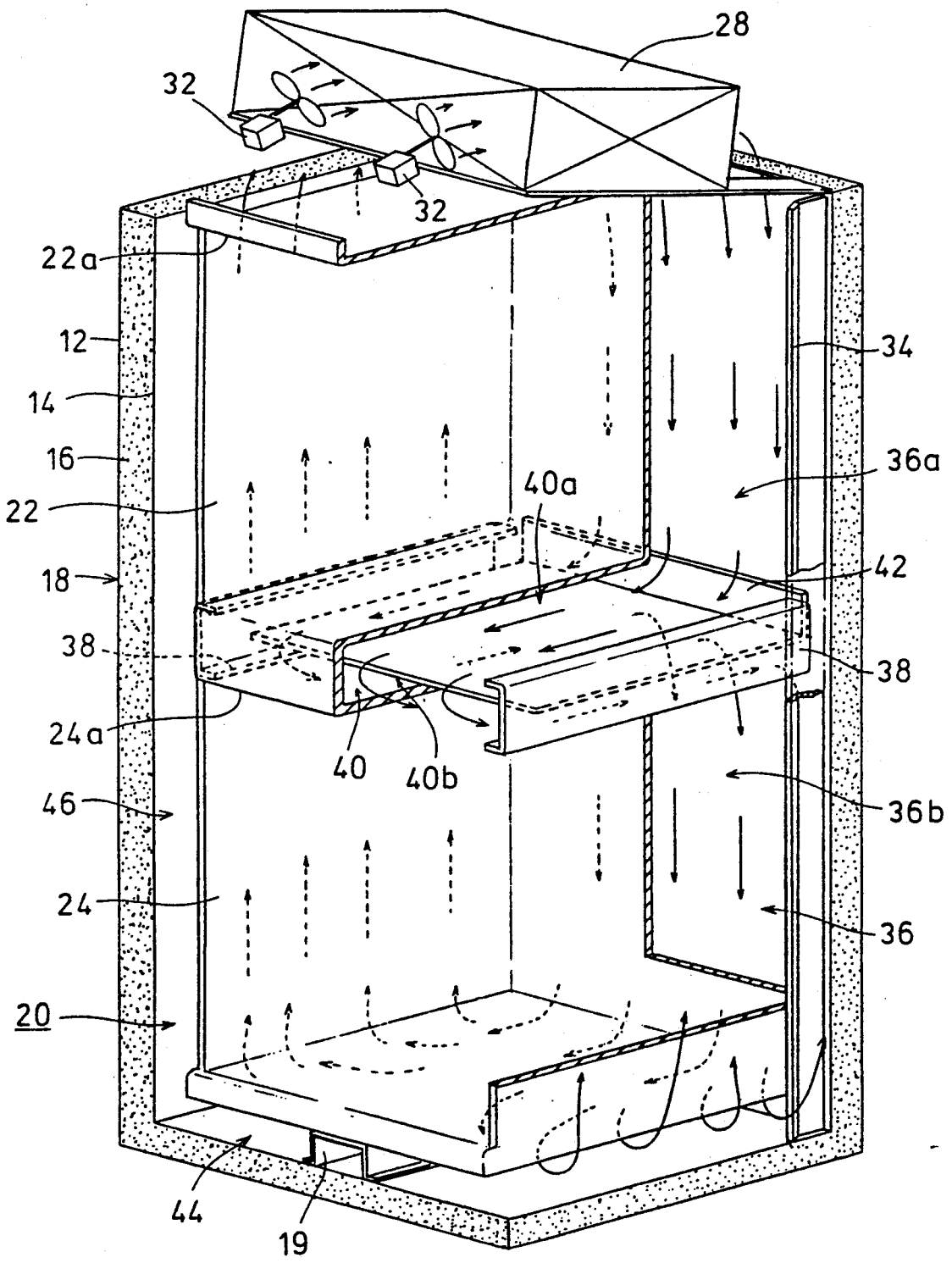
FIG. 1 is a perspective view for showing a longitudinal section in part of a vertical refrigerator constructed in accordance with the first preferred embodiment of this invention.
Figure 2:
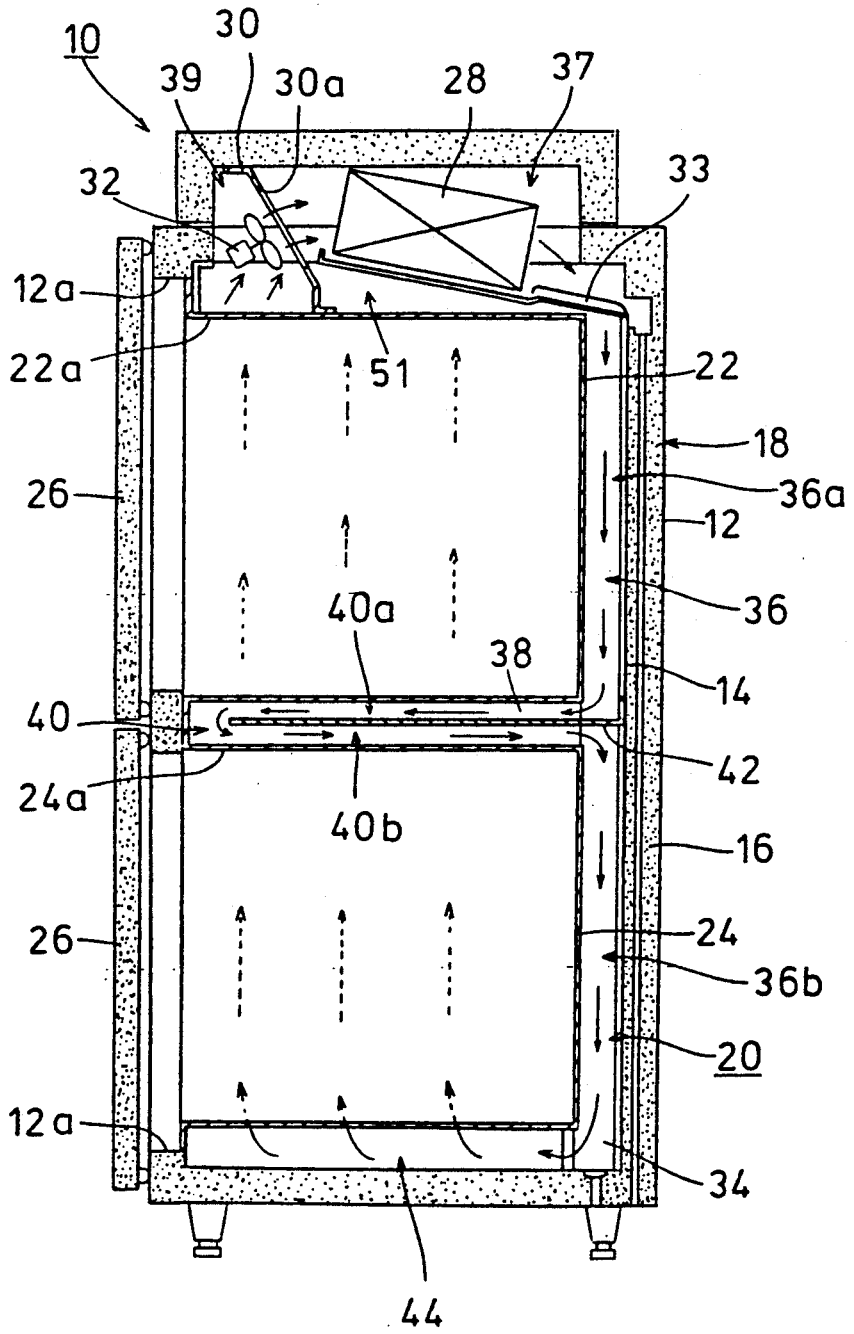
FIG. 2 is a side elevational view in longitudinal section of a refrigerator shown in FIG. 1.
Figure 3:
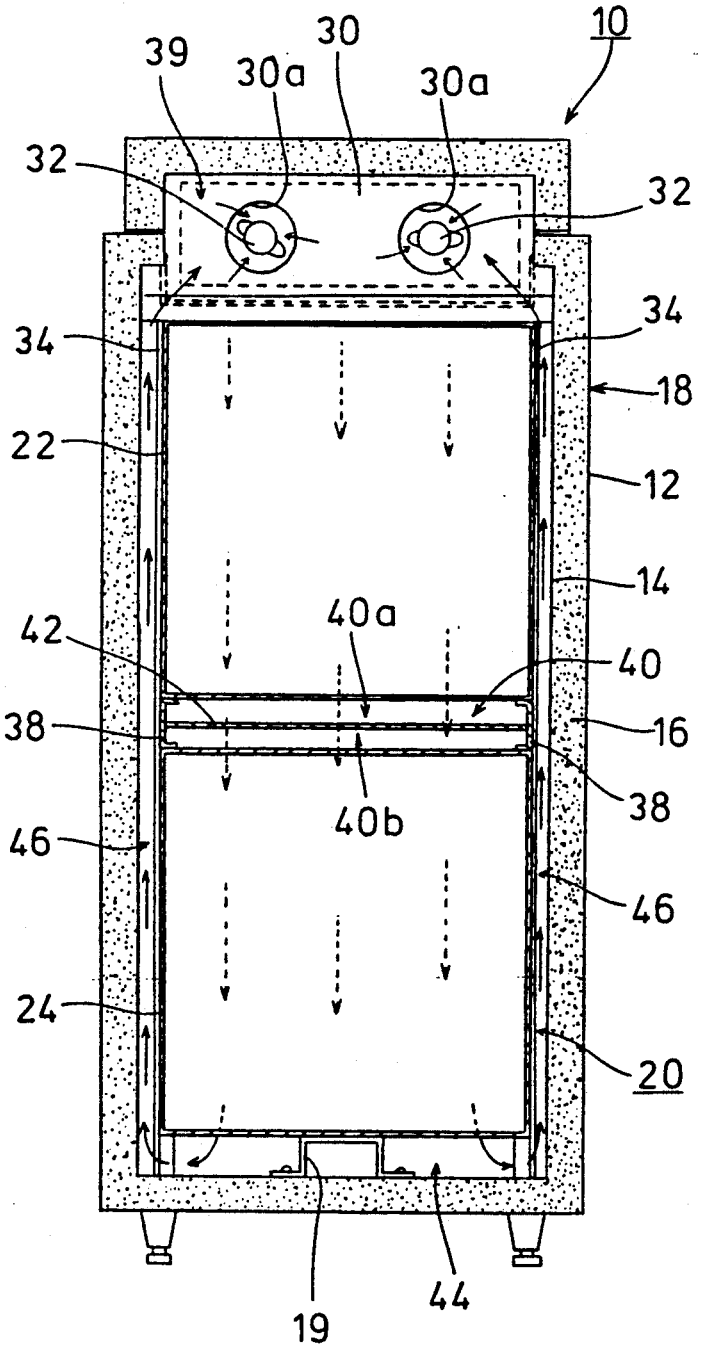
FIG. 3 is a front elevational view in a longitudinal section of a refrigerator shown in FIG. 1.

FIG. 1 is a perspective view for showing in a partial longitudinal section to illustrate a vertical type refrigerator constructed in accordance with the first preferred embodiment of this invention. FIG. 2 is a side elevational view in section for showing the refrigerator illustrated in FIG. 1. FIG. 3 is a front elevational view in longitudinal section for showing the refrigerator shown in FIG. 1.

As shown in the figures, a refrigerator 10 has a thermal insulating box 18 that is comprised of an outer box 12 having rectangular openings **12*a* and 12*a* spaced apart by a predetermined distance in a vertical direction and widely released at a front surface of the refrigerator, an inner box 14 assembled in this outer box 12 with a predetermined space being kept against it and similaly released widely at the front surface of the refrigerator, and a thermal insulation material 16 such as urethane foam and the like filled between the boxes 12 and 14. Within the inner box 14 in the thermal insulating box 18 are arranged an upper storing box 22 and a lower storing box 24 piled up through shielding plates 38 and 38 described later while a predetermined space 20 being held against its inner surface. The storing boxes 22 and 24** are formed by a better thermal conducting metallic plate such as a stainless steel plate and the like.

Figure 4:
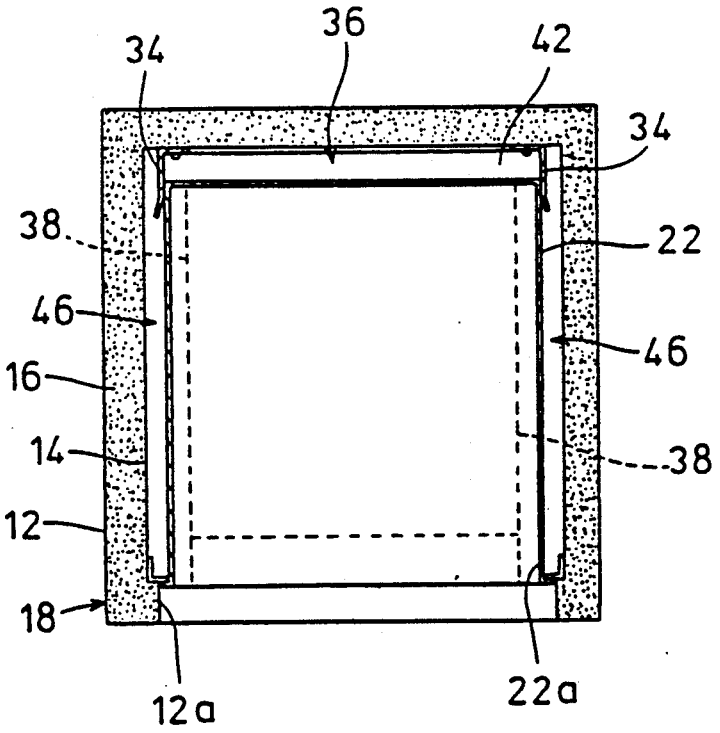
FIG. 4 is a top plan view in cross section for showing a refrigerator shown in FIG. 1.

As shown in FIG. 3, at an inner bottom surface of the inner box 14 is arranged a supporting member 19 projecting from a bottom surface by a predetermined height at a central part of its width direction. The lower storing box 24 is mounted on the supporting member 19 and then a bottom space 44 is defined between the lower storing box 24 and the bottom surface of the inner box 14. As shown in FIG. 4, at the inner rear surface of the inner box 14 are arranged oppositely a pair of storing box guides 34 and 34 formed in section in an L-shape by a spaced-apart relation by a lateral width size of the storing box 22.

The guides 34 and 34 extend over a substantial entire length in a vertical direction of the inner space in the inner box 14 and the rear surfaces of both storing boxes 22 and 24 are commonly fitted between the guides 34 and 34.

As described later, among the rear surfaces of the storing boxes 22, 24, storing guides 34, 34 and an inner wall of the inner box 14 is defined a rear passage 36 acting as a first passage for guiding the cold air so as to cool the storing boxes 22 and 24 while falling the cold air. In addition, width sizes of the storing boxes 22 and 24 are set smaller than an inner size of the inner box 14, thereby as shown in FIG. 4, at both side surfaces of the storing boxes 22 and 24 are defined side passages 46 and 46 acting as a second passage for guiding the cold air to cool the storing boxes 22 and 24 while raising the cold air. That is, the space 20 defined between the inner wall of the inner box 14 and the outer walls of the storing boxes 22 and 24 is constituted by a rear passage 36, a bottom space 44 and side passages 46 and 46.

The storing boxes 22 and 24 have rectangular openings **22*a* and 24*a* released forwardly in correspondence with the rectangular openings 12*a* and 12*a* formed on the thermal insulating box 18. As shown in FIG. 2, at the front surface of the thermal insulating box 18 are arranged thermal insulating doors 26 for closing the openings 12a in such a way that the openings 12a may be opened or closed in correspondence with each of the openings 12a formed in the thermal insulating box 18**.

A space defined between an inner ceiling surface of the inner box 14 and a ceiling surface of the upper storing box 22 is divided into two chambers 37 and 39 through a partition wall 30 as shown in FIG. 2. A first chamber 37 communicating with the rear surface passage 36 is provided with a cooling unit 28 communicating with a freezing device not shown so as to circulate the refrigerant from the freezing device to an evaporator stored in it. The second chamber 39 is communicated with the side passages 46 and 46. The second chamber 39 is communucated with aforesaid side passages 46, 46 and is provided with an air blowing fan 32 in correspondence with a plurality of openings 30a (two in the preferred embodiment) formed in the partition wall 30. Since this air blowing fan 32 is arranged so as to feed air in a direction toward the first chamber 37, the air within the refrigerator sucked through the side passages 46 and 46 under a driving operation of the air blowing fan 32 is contacted with the cooling unit 28 through the openings 30a, then the air is blown to the rear passage 36.

Reference numeral 33 denotes a water draining pan arranged below the cooling unit 28, and water drips dropped from the cooling unit 28 are transmitted along the water draining pan 33 and discharged out of the refrigerator. Then, a cold air passage 51 having a predetermined size is defined between the bottom surface of the water draining pan 33 and the ceiling surface of the upper storing box 22.

As shown in FIG. 3, the upper storing box 22 and the lower storing box 24 are piled up through ]-shaped shielding plates 38 and 38 oppositely arranged at both right and left side edges. The shielding plates 38 and 38 may act to define a horizontal passage 40 of predetermined size between the storing boxes 22 and 24. As described later, the shielding plates 38 are extended over an entire length of the storing box 22 in the depth direction and provides a function to prevent cold air fed from the rear passages 36 into the horizontal passage 40 from escaping to the side passages 46 and 46. A front side of the horizontal passage 40 is also closed and the passage 40 is communicated only with the rear passage 36 at its rear side.

As shown in FIG. 2, at an inner wall opposing to the horizontal passage 40 within the inner box 14 is projected a partition plate 42 dividing the horizontal passage 40 into the upper passage 40a and the lower passage 40b. The aforesaid rear passage 36 is also divided by the partition plate 42 into the upper rear passage 36a and the lower rear passage 36b. An outer diameter size of this partition plate 42 is set in such a way that both sides of the partition plate are abutted against the shielding plates 38 and 38 and a clearance having a predetermined size communicating with the upper passage 40a and the lower passage 40b may be arranged at the projecting extreme end of the partition plate.

Accordingly, the cold air blown from the cooling unit 28 into the upper rear passage 36a of the rear passage 36 may strike against the partition plate 42 and is fed into the upper passage 40a of the horizontal passage 40, passed through the lower passage 40b from the extreme end of the partition plate 42, thereafter the air is flown again into the lower rear passage 36b. In this way, the cold air flowing in the rear passage 36 is flown in the horizontal passage 40 and enabled to be contacted without any clearance with the bottom surface of the upper storing box 22 and the ceiling surface of the lower storing box 24, resulting in that a cooling efficiency of both storing boxes 22 and 24 can be improved.

The cold air passed through the lower passage 40b flows into the lower rear passage 36b in the rear passage 36, thereafter as shown in FIG. 3, is blown to the bottom space 44 defined in the bottom surface of the lower storing box 24. The cold air ascends in the side passages 46 and 46 communicating with the bottom space 44, cools each of the storing boxes 22 and 24 and then returns to the cooling unit 28 again.

(Modification of the First Preferred Embodiment)

Figure 5:
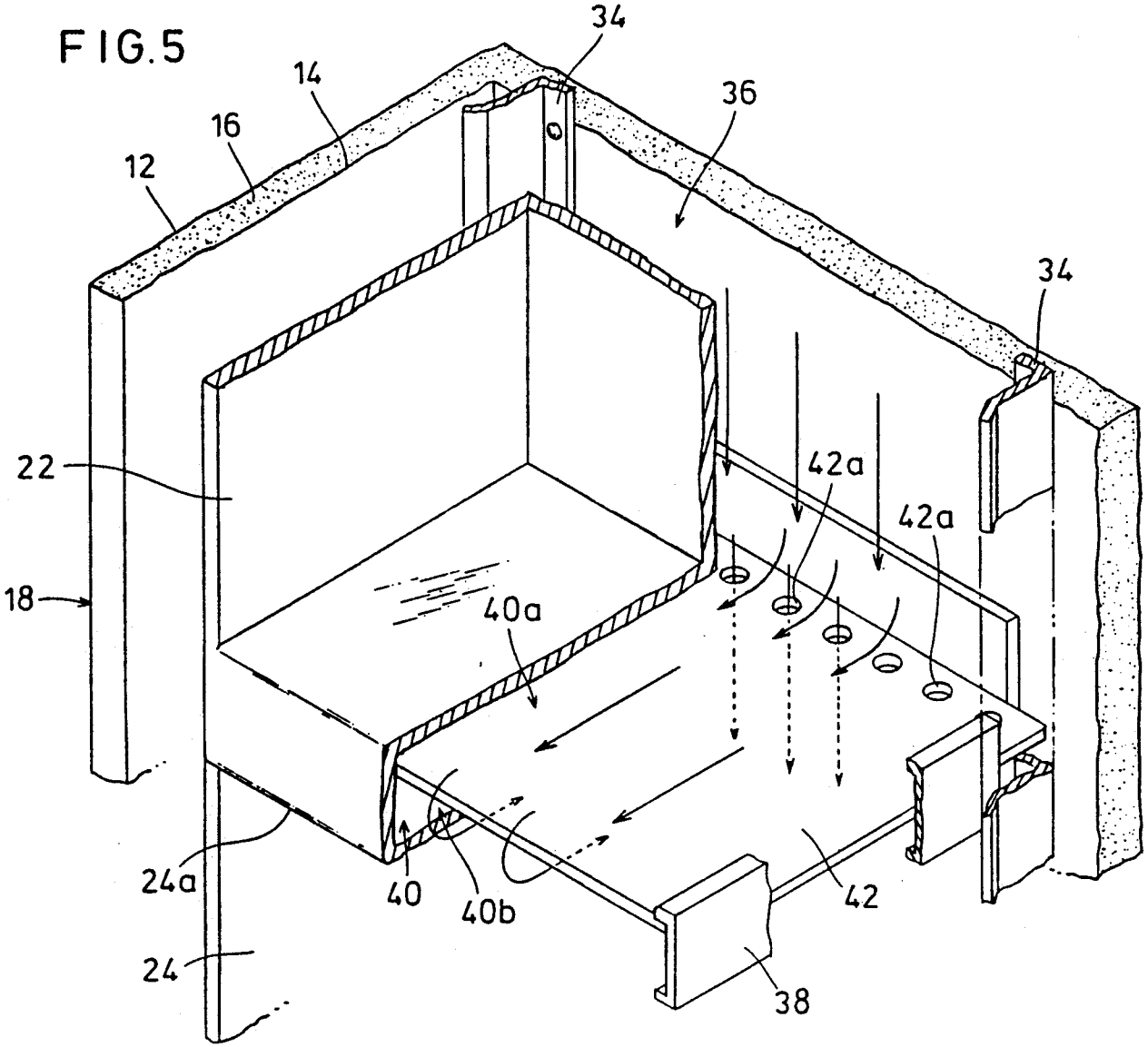
FIG. 5 is a schematic perspective view for showing a substantial part for illustrating a modification of a partition adapted in the first preferred embodiment shown in FIG. 1.

FIG. 5 illustrates a modification of the first preferred embodiment of this invention, wherein a plurality of throughholes 42a communicating with the upper rear passage 36a and the lower rear passage 36b at the locations adjacent to the rear passage 36 in the partition plate 42. Accordingly, a part of the cold air flowing down the upper rear passage 36a is not flown into the horizontal passage 40, but flows into the lower rear passage 36b. With this arrangement, a cooling efficiency at the bottom surface in the upper storing chamber 22 is lowered and it is possible to effectively prevent the the lower part of the upper storing box 22 from being over-cooled.

Namely, since the cold air has a characteristic of flowing from the upper part to the lower part, the cold air within the upper storing box 22 is accumulated at the inner bottom part of the refrigerator. At this time, since the cold air from the bottom surface of the upper storing box 22 is made to be restricted, the lower part of the storing box 22 is not over-cooled, but an inner temperature within the refrigerator can be made uniform. In addition, since the cold air not passing through the horizontal passage 40 is contacted with the rear surface of the lower storing box 24, it shows an advantage that a cooling efficiency of the lower storing box 24 is improved.

(Storing Box Supporting Structure)

Modification of the storing box supporting structure in the refrigerator constructed in accordance with the preferred embodiment will be described.

Figure 6:
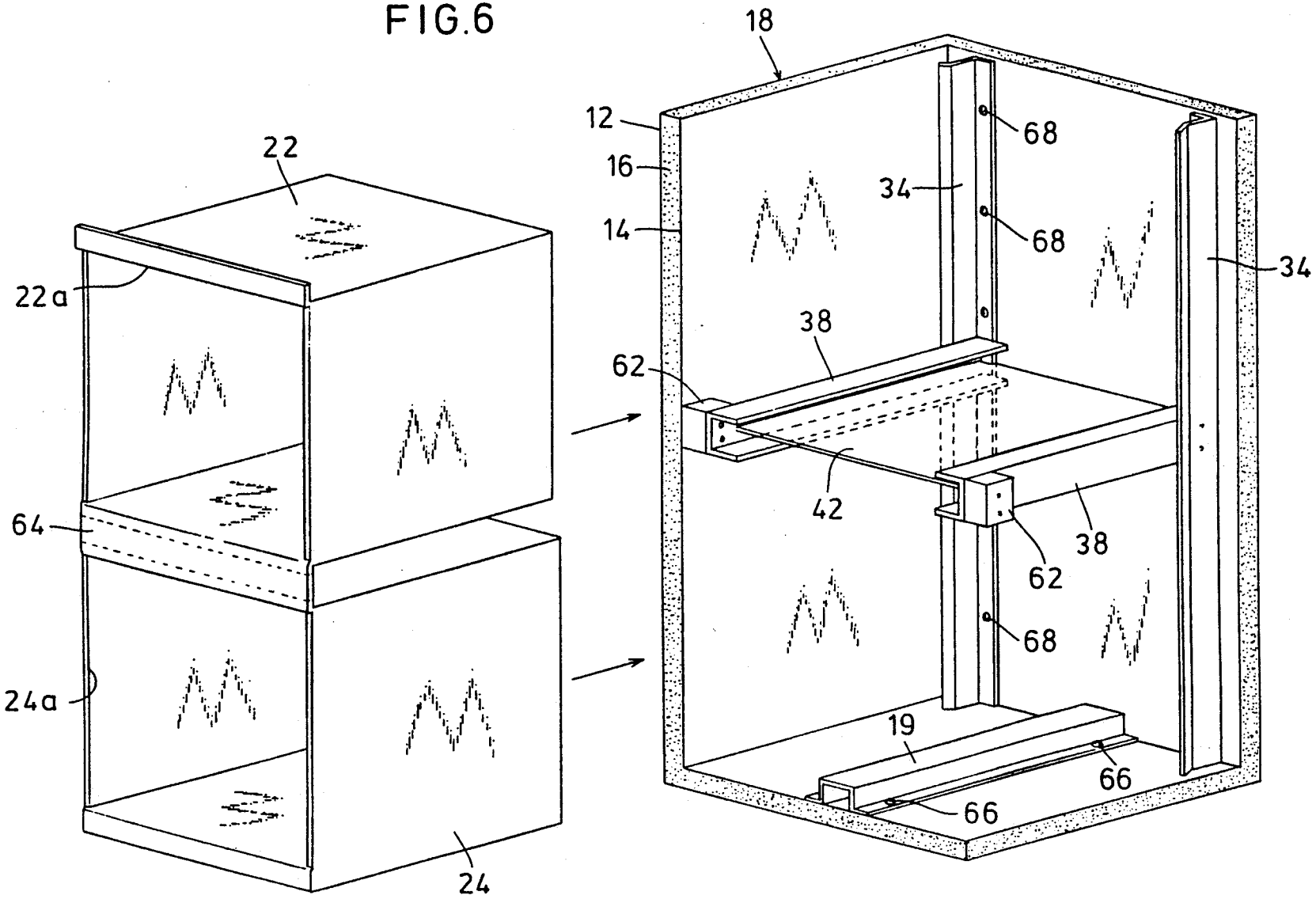
FIG. 6 is an exploded perspective view for showing a substantial part of a refrigerator to illustrate a supporting structure for a storing box.

As shown in FIG. 6, both storing boxes 22 and 24 are vertically spaced apart by a predetermined spacing and are integrally arranged at their front surface through a connecting plate 64 extending over an entire length of width direction of the storing boxes. The shielding members 38 oppositely arranged at right and left both side edges of the storing boxes 22 and 24 are fixed to the inner box 14 between the bottom surface of the upper storing box 22 and the ceiling surface of the lower storing box 24.

That is, the shielding members 38 are, as shown in FIG. 6, fixed to the inner side surfaces of the inner box 14 at their longitudinal extreme ends through spacers 62 and at the same time the other ends (end parts directing toward the rear surface) are fixed to the storing box guides 34 by screws 68 in the inner box rear surface. A length size of each of the shielding members 38 is set so as to extend over an entire depth length of the storing box 22. At the inner bottom surface of the inner box 14 is fixed a supporting member 19 at a central part of its width direction as described above through a plurality of screws 66. At this supporting member 19 is mounted the lower storing box 24 and at the same time the upper storing box 22 is mounted on the shielding members 38 and 38. In addition, the rear surfaces of both storing boxes 22 and 24 are commonly fitted to a pair of storing box guides 34 and 34. In this way, the storing boxes 22 and 24 are stored and supported through the supporting member 19 arranged in the inner box 14 and the storing box guides 34 and 34, thereby a space 20 comprising rear passage 36, bottom space 44 and side passages 46 and 46 is defined between the inner wall of the inner box 14 and the outer walls of both storing boxes 22 and 24.

In case of the refrigerator having the storing box supporting structure constructed in accordance with the modification, in order to assemble the storing boxes 22 and 24 to the refrigerator, at first, as shown in FIG. 6, the storing box guides 34 and 34 are fixed to the inner rear surface of the inner box 14 in the thermal insulating member 18 and at the same time, the shielding members 38 and 38 are fixed to both inner surfaces. The supporting member 19 is fixed to the inner bottom surface of the inner box 14. Then, the lower storing box 24 is mounted on the supporting member 19, both storing boxes 22 and 24 are moved along the supporting member 19 and the shielding members 38 and 38 while the upper storing box 22 being mounted on the shielding members 38 and 38 in a depth direction, resulting in that the storing boxes 22 and 24 are fitted to the storing box guides 34 and 34 and positioned.

A load applied to the upper storing box 22 is supported by the shielding members 38 and 38 extending in a depth direction at a lower part of the storing box 22, and another load applied to the lower storing box 24 is supported by the supporting member 19 extending in a depth direction at the lower part of the storing box 24. Accordingly, an anti-load characteristic of the storing boxes 22 and 24 is improved and much volume of meal products can be stored.

In this way, a mere fixing of storing boxes 22 and 24 within the inner box 14 through the shielding members 38 and 38, storing box guides 34 and 34 and supporting member 19 arranged within the inner box 14 causes passages 36, 44 and 46 (the spacing 20) through which the cold air is circulated to be defined between the outer walls of the storing boxes 22 and 24 and the inner wall of the inner box 14. Both storing boxes 22 and 24 are merely positioned and supported through the shielding members 38 and 38, storing box guides 34 and 34 and supporting member 19, resulting in that a mere pulling-out of both storing boxes 22 and 24 enables them to be easily removed from the inner box 14. It may also be applicable that the upper and lower storing boxes 22 and 24 are not integrally formed by the connecting plate 64, but both storing boxes 22 and 24 can be separated.

(Function of the First Preferred Embodiment)

In accordance with the refrigerator constructed by the preferred embodiment of this invention, operation of the refrigerator causes the interior air at the side passages 46 and 46 to the sucked by the air blowing fan 32, fed into the cooling unit 28 via the opening 30*a* of the partition wall 30, cooled through its heat exchanging operation, then the air is blown into the rear passage 36. A part of the cold air blown from the cooling unit 28 may perform a so-called short cycle in which it is circulated in the cold air passage 51 defined between the water draining pan 33 and the ceiling surface of the upper storing box 22 so as to cool the ceiling surface of the storing box 22.

As shown in FIG. 2, the cold air blown to the upper rear passage 36*a* of the rear passage 36 contacts with the rear surface of the upper storing box 22 and flows down while performing a heat exchanging operation, contacts to the partition plate 42 and its flow direction is deflected. The cold air flows along the partition plate 42 and passes through the upper passage 40*a* of the horizontal passage 40, thereafter it passes through the lower passage 40*b* and flows into the rear passage 36 below the partition plate 42. At this time, the cold air may contact to the bottom surface of the upper storing box 22 and the ceiling surface of the lower storing box 24 to perform a heat exchanging operation as to cool the storing boxes 22 and 24, resulting in that a cooling efficiency of each of the storing boxes 22 and 24 is improved.

The cold air flown again into the lower rear passage 36*b* contacts the rear surface of the lower storing box 24, flows down while performing a heat exchanging operation, thereafter the air is blown into the bottom space 44 and then contacts the bottom part of the storing box 24. In addition, the cold air may repeat such a cycle in which the air contacts both side surfaces of the storing boxes 22 and 24 while ascending in the side passages 46 and 46 so as to cool the storing boxes 22 and 24, thereafter the air is returned back to the cooling unit 28. Since the cold air blown into the bottom space 44 is heat-exchanged between the upper and lower storing boxes 22 and 24 and heated, the cold air is not accumulated at the bottom part of the thermal insulating box 18 and the cold air may be efficiently circulated.

In case that the cold air cooled by the cooler 28 is fallen, the cold air is caused to pass through the horizontal passage 40 defined between the upper storing box 22 and the lower storing box 24, so that the cold air can be uniformly distributed to the bottom surface of the upper storing box 22 and the ceiling surface of the lower storing box 24 and cooling efficiency of each of the storing boxes 22 and 24 can be improved. Accordingly, it is possible to cool the interior of the refrigerator down to a predetermined temperature in a rapid manner.

The first preferred embodiment is constructed such that the cold air cooled by the cooler 28 is circulated through the rear passage 36→horizontal passage 40→bottom space 44→side passages 46 and 46→cooler 28 so as to cool both storing boxes 22 and 24. However, in turn, the storing boxes 22 and 24 could be rapidly cooled by circulating the cold air cooled by the cooler 28 as through the side passages 46 and 46→horizontal passage 40→bottom space 44→rear passage 36→cooler 28. In case that the cold air is circulated from the rear surfaces of the storing boxes 22 and 24 to the side surfaces, a water drips caused by influence of the surrounding atmosphere may be efficiently prevented from being generated near the openings 22*a* and 24*a* of the storing boxes 22 and 24.

(Second Preferred Embodiment)

FIGS. 7 to 11 illustrate a second preferred embodiment of the refrigerator of this invention. In the first preferred embodiment, the cold air is passed through the horizontal passage 40 defined between the upper storing box 22 and the upper storing box 24 so as to make a uniform cooling of the storing boxes 22 and 24. In turn, in the second preferred embodiment, in addition to the configuration of the first preferred embodiment, the cold air blown from the cooler 28 is divided into a cold air for cooling only the upper storing box 22 and another cold air for cooling only the lower storing box 22, thereby both storing boxes 22 and 24 can be cooled uniformly and rapidly.

Figure 7:
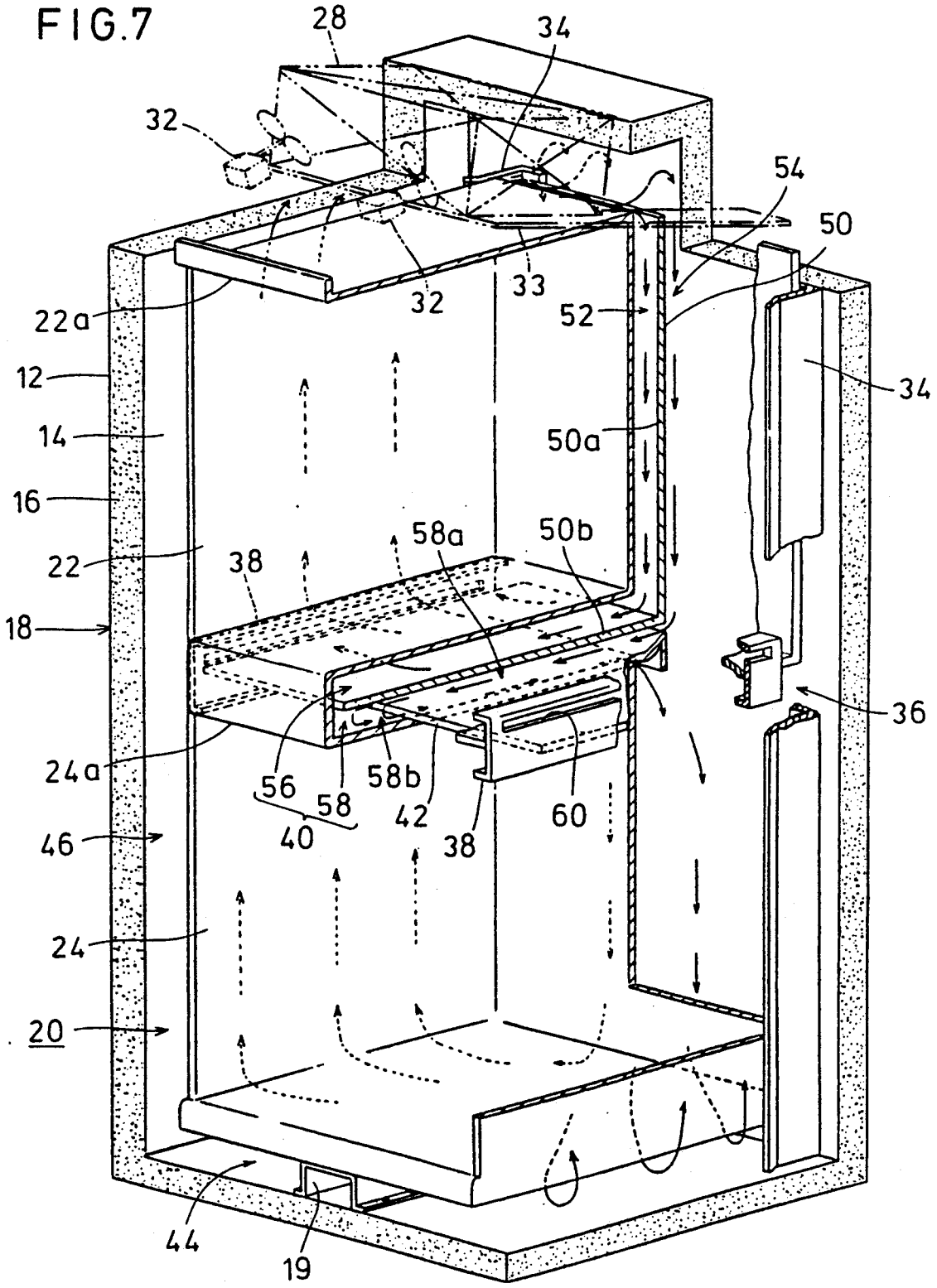
FIG. 7 is a perspective view in a longitudinal section of a vertical refrigerator constructed in accordance with a second preferred embodiment of this invention.

As show in FIG. 7, the upper storing box 22 and the lower storing box 24 are stored and supported through the storing box guides 34 and 34 and the supporting member 19 arranged within the inner box 14, and then a spacing 20 comprising rear passage 36, bottom spacing 44, side passages 46 and 46 is defined between the inner wall of the inner box 14 and the outer walls of the storing boxes 22 and 24. Both storing boxes 22 and 24 are piled up through the shielding members 38 and 38 oppositely arranged at the right and left side edges and then the horizontal passage 40 is defined between the storing boxes 22 and 24.

Figure 8:
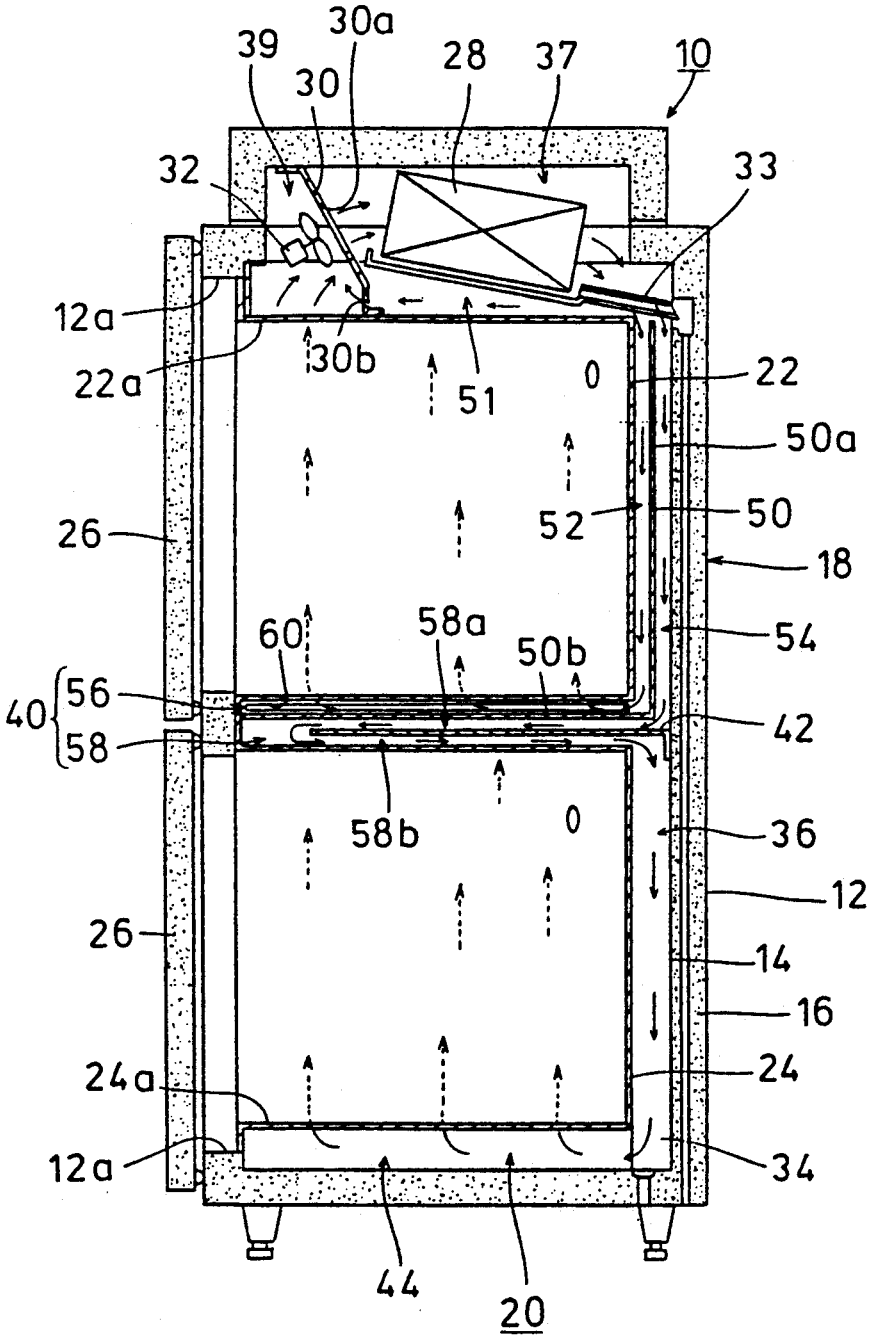
FIG. 8 is a side elevational view in longitudinal section of a refrigerator shown in FIG. 7.

As shown in FIG. 8, a cold air passage 51 is defined between the bottom surface of the water draining pan 33 arranged at the lower surface of the cooler 28 and the ceiling surface of the upper storing box 22, a part of the cold air blown from the cooler 28 is circulated within the cold air passage 51 so as to perform a so-called short cycle. A plurality of through-holes **30*b* are formed at positions opposing to the cold air passage 51 in the partition wall 30 so as to cause the part of cold air circulating in the cold air passage 51 to be fed into the second chamber 39 through the through-holes 30*b***.

Figure 9:
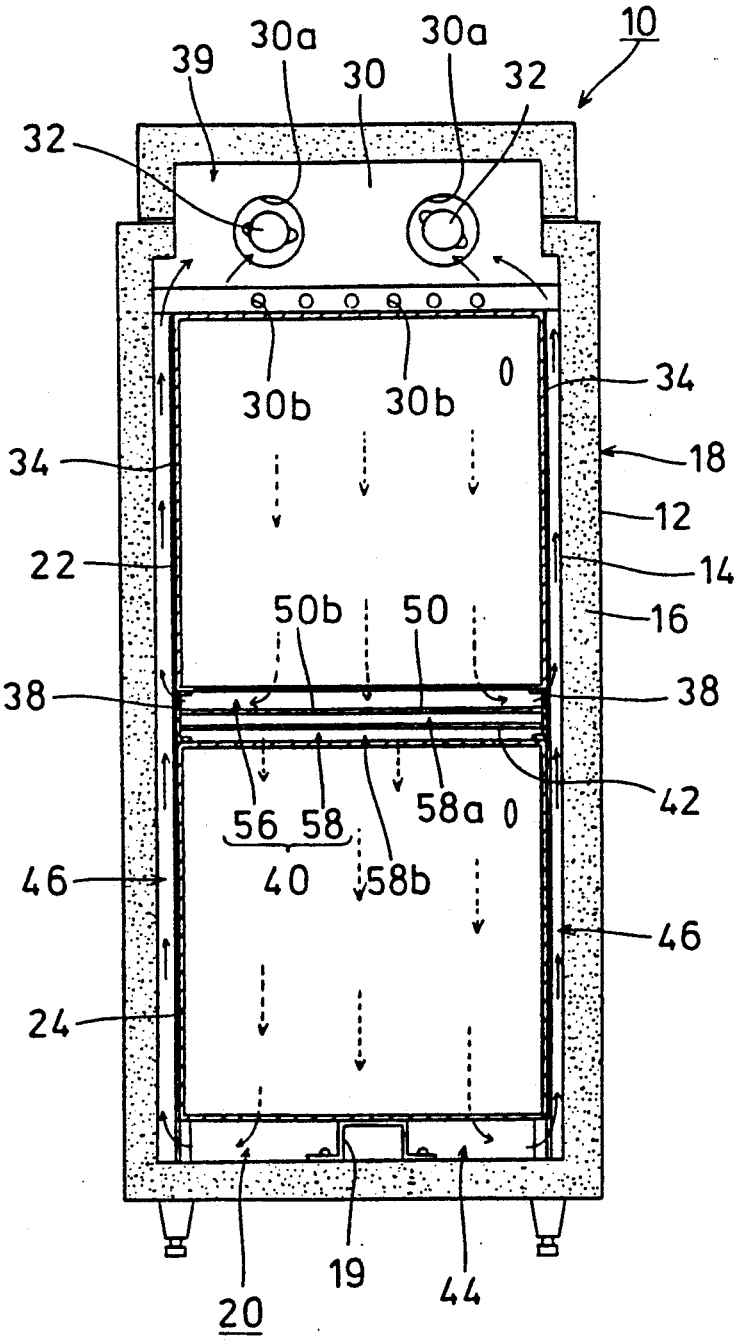
FIG. 9 is a front elevational view in longitudinal section of a refrigerator shown in FIG. 7.
Figure 10:
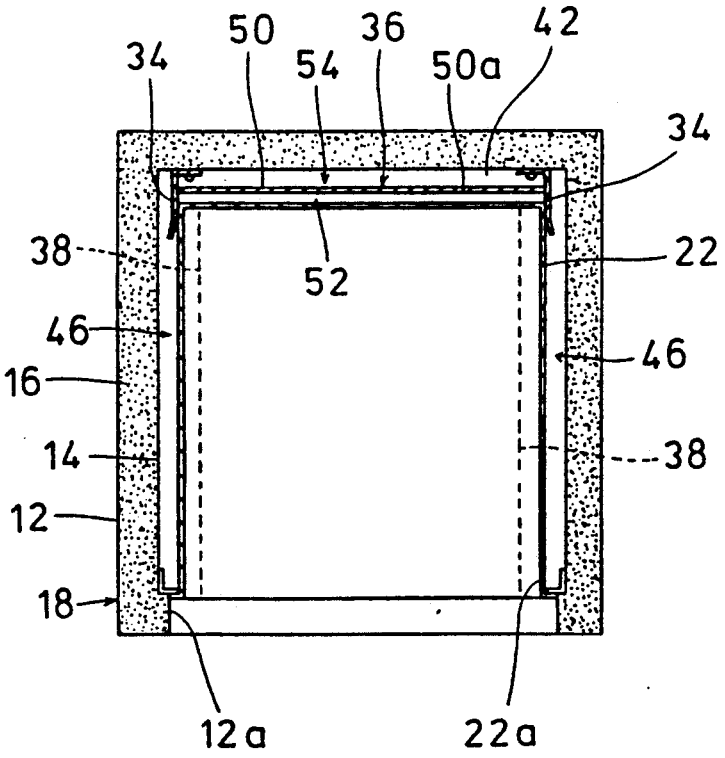
FIG. 10 is a top plan view in cross section for showing a refrigerator in FIG. 7.

As shown in FIGS. 7 and 9, the shielding members 38 and 38 arranged at the opposing upper and lower surfaces of the upper storing box 22 and the lower storing box 24 are formed with through-holes 60 communicating with the side passages 46 at the positions adjacent to the upper passage 56 defined by the horizontal part **50*b* of the defining plate 50 to be described later. The through-holes 60 may act to outflow the cold air flown into the upper passage 56 to the side passages 46**.

As shown in FIG. 8, the defining plate 50 having an inverted L-shaped section is commonly inserted into the rear passage 36 adjacent to the rear surface of the upper storing box 22 and the horizontal passage 40, and then the passages 36 and 40 are divided into double segments. Namely, a vertical part **50*a* of the defining plate 50 is positioned in the rear passage 36, and the rear passage 36 adjacent to the rear surface of the upper storing box 22 is divided by the vertical part 50*a* into a first cold air passage 52 for guiding the cold air while contacting it to the rear surface of the upper storing box 22 and a second cold air passage 54 for guiding the cold air without being contacted with the upper storing box 22 (refer to FIG. 10). The horizontal part 50*b* of the defining plate 50 extends up to a front end of the horizontal passage 40 while its both right and left ends being abutted against the shielding members 38 and 38 so as to define the horizontal passage 40 into the upper passage 56 and the lower passage 58**.

The shielding members 38 are not necessarily an integral member, but the shielding members 38 may be divided into upper and lower segments so as to hold both right and left side portions of the horizontal part 50 in the defining plate 50 between them and to punch through-holes 60 in the shielding members 38 positioned above.

With this arrangement above, the cold air blown from the cooler 38 toward the rear passages 36 is divided into the first cold air passage 52 and the second cold air passage 54 and flown down. The cold air flown down the first cold air passage 52 flows into the upper passage 56 to contact with the rear surface and the bottom surface of the upper storing box 22 to perform a heat exchanging operation. The cold air flown into the upper passage 56 outflow into the side passages 46 and 46 through the through-holes 60 and 60 punched in the shielding members 38 and 38, thereafter the cold air ascends while being contacted with both side surfaces of the upper storing box 22 and then returns to the cooler 28. The cold air flowing down the second cold air passage 54 is fed into the lower passage 58 through the partition plate 42 to be described later without performing a heat exchanging operation with the upper storing box 22, where the cold air is contacted with the ceiling surface of the lower storing box 24 to perform a heat exchanging operation.

Figure 11:
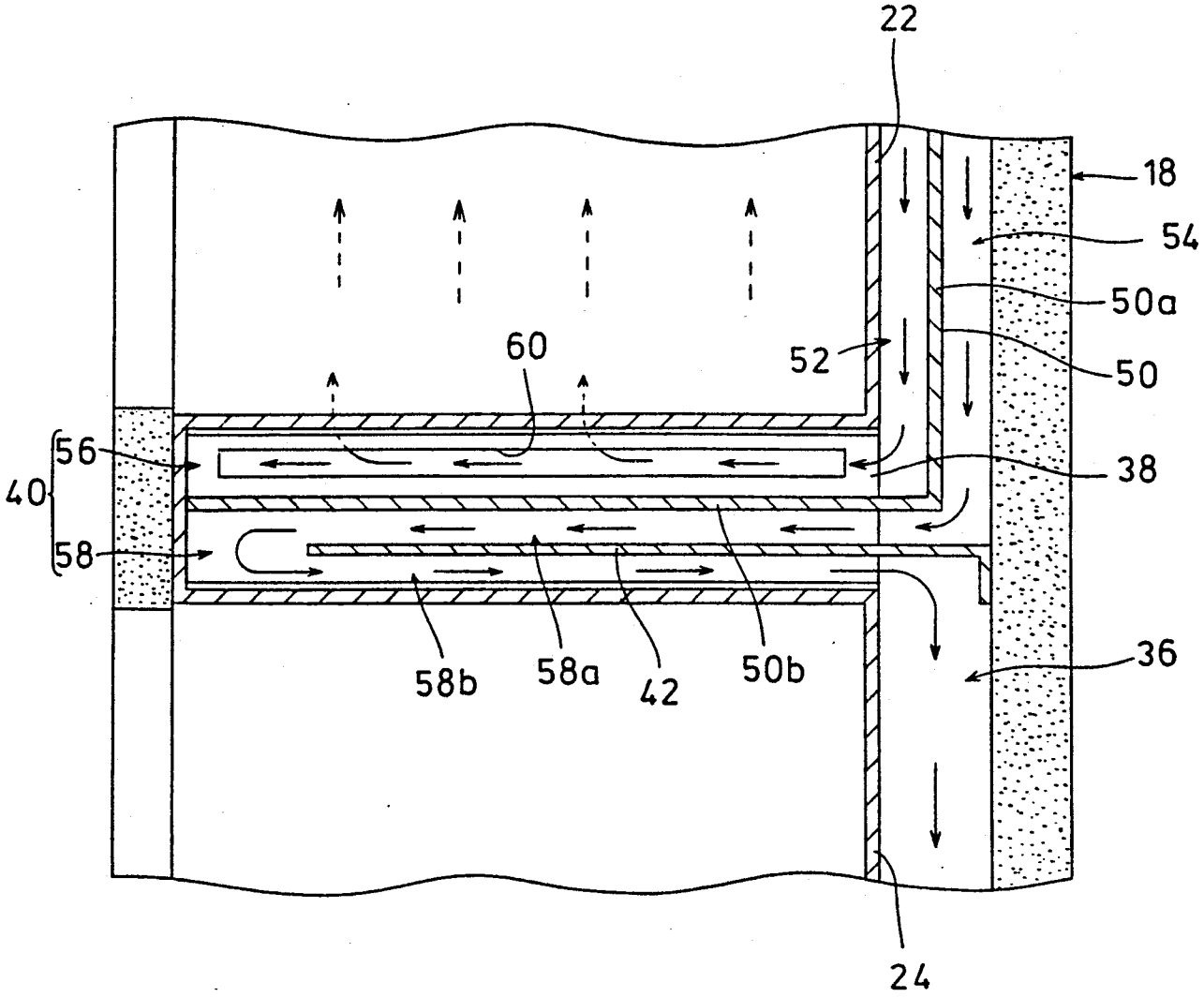
FIG. 11 is an enlarged side elevational view in longitudinal section for showing a substantial part to illustrate a flow of cold air flowing within a horizontal passage defined between the opposing surfaces of an upper storing box and a lower storing box.

As shown in FIGS. 8 and 11, at the inner wall opposing to the lower passage 58 of the horizontal passage 40 in the inner box 14, the partition plate 42 dividing the lower passage 58 into the upper circulating passage **58*a* and the lower circulating passage 58*b* is projected in parallel with the horizontal part 56*b* of the defining plate 50. The rear passage 36 is also divided into upper and lower segments by the partition plate 42 and the cold air flowing down the second cold air passage 54 is deflected by the partition plate 42 toward the lower passage 58. As shown in FIGS. 9 and 11, the outer diameter size of the partition 42 is set such that its both side abut against the shielding members 38 and 38 so as to provide a clearance of desired size for communicating the upper circulating passage 58*a* with the lower circulating passage 58*b*** at its projecting extreme end.

Accordingly, the cold air flowing down the second cold air passage 54 of the rear passage 36 is abutted against the partition plate 42 and fed into the upper circulating passage **58*a* of the lower passage 58, passes through the upper circulating passage 58*b* from the extremity end of the partition plate 42, thereafter the cold air is flown again into the rear passage 36. The cold air flown into the rear passage 36 and flown down while being contacted with the rear surface of the lower storing box 24 is blown out into the bottom space 44 defined at the bottom surface of the lower storing box 24 as shown in FIG. 9, thereafter the cold air cools each of the storing boxes 22 and 24 while ascending the side passages 46 and 46 communicating with the bottom space 44 and then the cold air is returned back to the cooler 26** again.

In the second preferred embodiment, the upper and lower storing boxes 22 and 24 can be uniformly cooled even if the partition plate 42 is not provided.

(Modification of the Second Preferred Embodiment)

Figure 12:
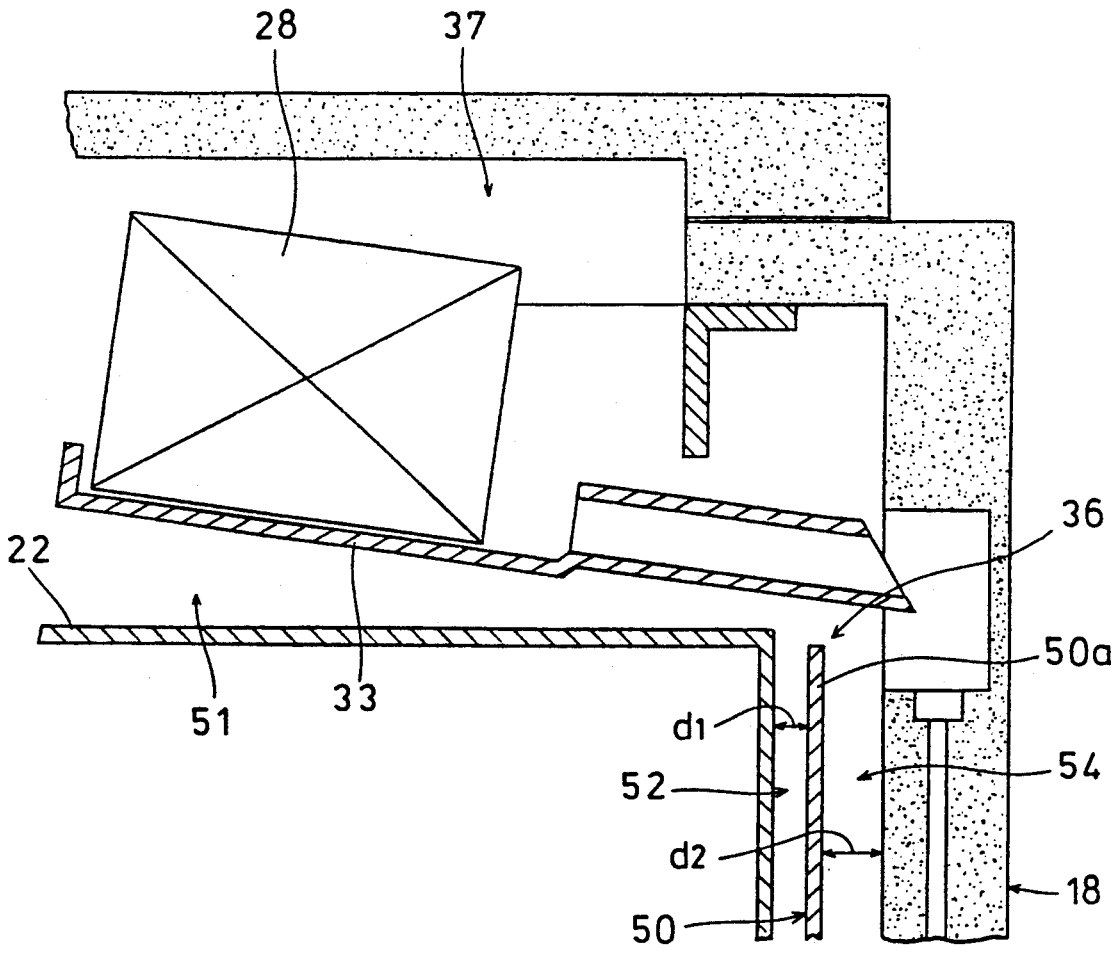
FIG. 12 is an enlarged side elevational view in longitudinal section for showing a substantial part of a modification of a second preferred embodiment shown in FIG. 7.

Then, FIG. 12 illustrates an example of modification of the second preferred embodiment, wherein a width size $d_1$ of the first cold air passage 52 defined by the vertical part **50*a* of the defining plate 50 is smaller than a width size $d_2$ of the second cold air passage 54 ($d_1 < d_2$). That is, since a passage in which the cold air blown from the cooler 28 flows to cool the lower storing box 24 through the second cold air passage 54 is longer than a passage where the cold air passes through the first cold air passage 52 to cool the upper storing box 22, a resistance against the flow of cold air is increased and a flow rate of the cold air at the first cold air passage 52 is different that of the second cold air passage 54. Thus, as shown in FIG. 12, a width side of the second cold air passage 54** is set wider, the resistance against the flow of cold air is reduced. Accordingly, the cold air is flown smoothly in the second cold air passage 54 to enable the flow rates of cold air flowing in the cold air passages 52 and 54 to be equal to each other and further the upper and lower storing boxes 22 and 24 can be more uniformly cooled.

(Function of the Second Preferred Embodiment)

According to the refrigerator constructed in reference to the second preferred embodiment above, operation of the refrigerator causes the air within the side passages 46 and 46 to be sucked by the air blowing fan 32, fed into the cooler 28 through the openings 30*a* of the defining wall 30, where the cold air is cooled at a heat exchanging action, thereafter the cold air is blown to the rear passage 36. A part of the cold air blown from the cooler 28 is circulated in the cold air passage 51 defined between the water draining pan 33 and the ceiling surface of the upper storing box 22 to cool the ceiling surface of the storing box 22 so as to accomplish a so-called short cycle. Arrangement of punched through-holes 30*b* of the defining wall 30 corresponding to the cold air passage 51 in view of their positions causes the cold air passage 51 communicating with the second chamber 39 to become a negative pressure and further the cold air blown from the cooler 28 may easily flow into the cold air passage 51.

The cold air blown to the rear passage 36 is branched, as shown in FIGS. 8 and 11, to the first cold air passage 52 and the second cold air passage 54 defined by the vertical part 50*a* of the defining plate 50 and then the cold air drops. The cold air flown into the first cold air passage 52 drops while contacting with the rear surface of the upper storing box 22 to perform a beat exchanging operation, its flow is deflected by being striken against the horizontal part 50*b* of the defining plate 50 and flowed into the upper passage 50 and then the cold air flown into the upper passage 56. The cold air flown into the upper passage 56 is contacted with the bottom surface of the upper storing box 22 to perform a heating exchanging operation, thereafter the cold air is flown out of the through-holes 60 and 60 punched in the shielding members 38 and 38 into the side passages 46 and 46. In addition, the cold air is contacted with both side surfaces of the upper storing box 22 over the side passages 46 and 46 to perform a heat exchanging operation and ascends to return to the cooler 28 to perform this cycle.

The cold air branched to the second cold air passage 54 flows down to the installing position of the partition plate 42 without performing any heat exchanging operation between it and the upper storing box 22, strikes against the partition plate 42 to cause its flow to be deflected. The cold air passes through the upper circulating passage 58*a* of the lower passage 58, thereafter the cold air passes through the lower circulation passage 58*b* and flows into the rear passage 36 positioned below the partition plate 42. At this time, the cold air is not contacted with the bottom surface of the upper storing box 22 and contacted only with the ceiling surface of the lower storing box 24 to perform a heat exchanging operation, so that the lower storing box 24 can be efficiently cooled.

The cold air flown into the rear passage 36 again is contacted with the rear surface of the lower storing box 24 to perform a heat exchanging operation, then flows down and is blown to the bottom space 44, where the cold air is contacted with the bottom surface of the storing box 24. In addition, the cold air is contacted with both side surfaces of both storing boxes 22 and 24 to cool the storing boxes 22 and 24 while ascending in the side passages 46 and 46, thereafter the cold air repeats the cycle to return to the cooler 28 again. The cold air blown to the bottom space 44 is heat exchanged between it and the lower storing box 24 to be heated, so that the cold air is not accumulated at the bottom part of the thermal insulation member 18 and the cold air is efficiently circulated.

In this way, the cold air cooled by the cooler 28 is divided into one cold air for use in cooling the upper storing box 22 and the other cold air for use in cooling the lower storing box 24, resulting in that both storing boxes 22 and 24 can be uniformly cooled. That is, the lower storing box 24 can be cooled with the cold air not heat exchanging between it and the upper storing box 24, so that cooling efficiencies of both storing boxes 22 and 24 can be made equal each other. Further, since the cold air is contacted with the bottom usrface of the upper storing box 22 and the ceiling surface of the lower storing box 24 without any clearance, so that it has some advantages that a cooling efficiency of each of the storing boxes 22 and 24 is improved and the interior of the refrigerator can be rapidly cooled.

What is claimed is:

1. A refrigerator comprising a thermal insulation box having a plurality of openings and a thermal insulation door arranged at each of the openings, a plurality of storing boxes arranged within said thermal insulation boxes under a vertical relation through a predetermined spacing and having openings to be released in correspondence with said openings, and a cooler arranged above an upper storing box in said thermal insulation boxes characterized in that the same is comprised of:

a horizontal passage defined between the storing boxes arranged in said vertical relation to communicate with said internal spacing; and a partition plate for dividing said horizontal passage and the internal spacing into upper and lower segments to communicate the upper passage and the lower passage of the horizontal passage at the position spaced apart from a communication part between said horizontal passage and the internal spacing, wherein the cold air coming from any one of the upper and lower internal spacings is communicated within the horizontal passage along the partition plate, and through holes communicating vertically and punched at locations adjacent to the internal spacing at said partition plate.

2. A refrigerator comprising a thermal insulation box having a plurality of openings and a thermal insulation door arranged at each of the openings, a plurality of storing boxes arranged within said thermal insulation boxes under a vertical relation through a predetermined spacing and having openings to be released in correspondence with said openings, and a cooler arranged above an upper storing box in said thermal insulation boxes characterized in that the same is comprised of;

the internal spacing of said thermal insulation box is divided into a first passage communicating with a cold air blowing part of the cooler and guiding the cold air blown from said cooler to cool said storing boxes while falling it, and a second passage communicating with a cold air sucking side of the cooler to cool the storing boxes while raising the cold air descended down to the bottom part of said thermal insulation box and guiding it again to the cooler, a horizontal passage communicating with said first passage is defined between the storing boxes arranged in a vertical relation, and said horizontal passage and the first passage are divided into an upper segment and a lower segment by a partition plate, and the upper passage and the lower passage defined in the horizontal passage are communicated at a side opposite to a side communicating with the first passage.

3. A refrigerator as set forth in claim 2 characterized in that through-holes communicating vertically are punched at locations adjacent to the internal spacing at said partition plate.

4. A refrigerator comprising a thermal insulation box having a plurality of openings and a thermal insulation door arranged at each of the openings, a plurality of storing boxes arranged within said thermal insulation boxes under a vertical relation through a predetermined spacing and having openings to be released in correspondence with said openings, and a cooler arranged above an upper storing box in said thermal insulation boxes characterized in that the same is comprised of;

a first passage for guiding the cold air blown from said cooler to descend and a second passage for guiding the cold air descended in said first passage to ascend again to return to the cooler, a horizontal passage defined by the shielding members oppositely arranged at both right and left edges in the upper and lower opposing surfaces of said storing boxes and communicated with said first passage, a defining plate for partitioning the first passage adjacent to an outside part of said upper storing box and the horizontal passage into double segments, and through-holes punched in said shielding members adjacent to the upper passage partitioned by the partitioning plate in said horizontal passage so as to communicate said upper passage with said second passage.

5. A refrigerator as set forth in claim 4 in which a width size of a first cold air passage at the upper storing box partitioned by the partitioning plate in said first passage is set smaller than a width size of the second cold air passage at the thermal insulation box.

6. A refrigerator as set forth in claims 4 or 5 characterized in that a lower passage partitioned by a defining plate within said horizontal passage has a partition plate arranged therein for dividing said lower passage and said first passage into an upper segment and a lower segment so as to communicate an upper circulating passage and a lower circulating passage defined in the lower passage with a side opposite to a side communicating with the first passage.

* * * * *